US005656327A

United States Patent [19]

Ihle

[11] Patent Number: 5,656,327

[45] Date of Patent: Aug. 12, 1997

[54] PROCESS FOR TEMPORARILY CONSOLIDATING A BED OF BROKEN STONES

[75] Inventor: Clausdieter Ihle, Mullheim, Germany

[73] Assignee: Koch Marmorit GmbH (DE/DE), Bollschweil

[21] Appl. No.: 331,665

[22] PCT Filed: May 5, 1993

[86] PCT No.: PCT/EP93/01088

§ 371 Date: Mar. 6, 1995

§ 102(e) Date: Mar. 6, 1995

[87] PCT Pub. No.: WO93/22502

PCT Pub. Date: Nov. 11, 1993

[30] Foreign Application Priority Data

May 7, 1992 [DE] Germany ..... 42 14 890.1

[51] Int. Cl.[6] ..... B05D 7/00

[52] U.S. Cl. ..... 427/154; 427/136; 427/420

[58] Field of Search ..... 427/136, 154, 427/420

[56] References Cited

U.S. PATENT DOCUMENTS 5,372,844 12/1994 Ihle et al. ..... 427/420

FOREIGN PATENT DOCUMENTS

91/08056 6/1991 WIPO .

OTHER PUBLICATIONS

Railway Engineer International, vol. 5 (1980) Jan., "Can Ballast be Stabilised by Glueing" pp. 51–54.

*Primary Examiner*—Katherine A. Bareford
*Attorney, Agent, or Firm*—McDonnell Boehnen Hulbert & Berghoff

[57] ABSTRACT

The process for the temporary consolidation of railroad track ballast, in particular during the time of redevelopment or reconstruction of a parallel set of tracks, is performed in that the ballast is cemented partially in particular in the side area by a multi component adhesive, wherein this cementation may be broken up mechanically later without affecting reuse of the ballast.

4 Claims, No Drawings

PROCESS FOR TEMPORARILY CONSOLIDATING A BED OF BROKEN STONES

This Application is a National Stage application of PCT/EP93/01088, filed May 5, 1993.

BACKGROUND AND OBJECT OF THE INVENTION

Object of the present invention is a process for the temporary consolidation of railroad track ballast, or a bed of broken stones in particular during the time of redevelopment or reconstruction of a parallel set of tracks. Up to the present such a temporary consolidation of railroad track ballast was performed by pile driving S-shaped iron boards near the track or by driving in iron cribs with pointed side anchorages. Without such temporary consolidations the ballast would swim away due to the shocks of railroad traffic on the one side as well as due to the vibrations and shocks near to the ballast during redevelopment or reconstruction of a parallel set of tracks on the other side and thereby endanger stability and adjustment of the railroad track.

Pile driving of the S-shaped iron boards as well as driving in the iron cribs with anchorages is connected with a serious noise pollution hardly endurable in particular near by resedential districts. Therefore the object of the invention is to provide a process for the temporary consolidation of railroad tracks being achievable in a simple, safe and noiseless way.

SUMMARY OF THE INVENTION

This object may be solved in a surprisingly simple way by partially cementing the ballast, especially in the side area, with a multi component adhesive, whereby this cementation may be broken up later mechanically without affecting reuse of the ballast. The latter is important above all because often, after having reconstructed or redeveloped the one railroad track, the railroad traffic subsequently is directed over this one and subsequently the track used before is to be reconstructed or redeveloped. On this occasion the ballast material always should be reused. Therefore the cementation should not be so intensive such that it cannot be broken up again.

DETAILED DESCRIPTION OF THE PREFERRED EMBODIMENT

The multi component adhesive preferably is applied by feeding the components of the adhesive separated physically from each other under a pressure from 30 to 200 bar to a mixing chamber, mixing them in the mixing chamber turbulently with each other and applying laminarly the mixture under a pressure from 2 to 6 bar by means of a flat curtain-like film on the ballast. This process prevents a premature breaking of the film and the formulation of drizzles. Moreover, this process allows one to work avoid solvents. This process ensures in addition that the ballast material initially is wetted completely and that adhesive bridges are formed at the contact points. On no account the voids should be felled as this would make rebreaking and reuse of the ballast material impossible.

The process for applying appropriate multi component adhesives as well as a device suited for this is, for example, described in the applicants WO 91/08056. Specifically, as described in WO 91/08056, preferred multi-component adhesives include epoxide resin adhesives as well as polyurethane resin adhesives. An appropriate epoxide resin adhesive, for instance, may consist of a resin component and a hardener component. The resin component may consist of nonbrominated bisphenol A resins and cycloaliphatic resins. Added thereto may be monofunctional and/or bifunctional reactive thinners, phosphoric esters as flame retardants, silicic acid esters as primers, and a silicone defoamer. The hardener component may consist of adducts of amines, amides, phenol-free Mannich bases or mixtures thereof, benzyl alcohol as a promoter, silicic acid ester as a primer, and silicone defoamer. A thin curtain of these multi-component adhesives may be laminarly applied to the ballast by means of a fan spray nozzle.

To perform the process according to the invention at least at the side area of the ballast so much multi component adhesive is applied that an anchorage up to the subsoil takes place. In case of a subsequent rebreaking of the ballast for the purpose of redevelopment or reconstruction of this railroad track in has turned out than the contact point cementations of the ballast may be rebroken without destructing the ballast. Therefore this ballast may be reused easily.

Application of the two component adhesive takes place practically without noise pollution of the neighbourhood and in addition in an ecologically beneficial way as usage of organic solvents and forming of drizzles is avoided. However, the endurance of ballast cementation is completely sufficient for stabilizing the track body against heavy vibrations and loadings for several months without mechanically securing it laterally against "floating away".

The process according to the invention is as well suited to stabilize track bodies with ballast if pilings or other works are to be performed nearby leading to prolonged and intensive shocks of the ballast, e.g., redevelopment works at bridges, which may as well lead to a "floating away" of the ballast.

I claim:

1. A process for temporarily consolidating railroad track ballast during redevelopment or reconstruction of a parallel set of railroad tracks, said ballast underlying said parallel set of railroad tracks and extending under said railroad tracks from a first side to a second side, said process comprising:

(a) cementing said ballast by applying a multi-component adhesive to said ballast, said multi-component adhesive comprising an epoxide resin adhesive;

(b) subsequently conducting said redevelopment or reconstruction of said parallel set of railroad tracks; and (c) subsequently mechanically breaking up said ballast without affecting reuse of said ballast.

2. A process for temporarily consolidating railroad track ballast during redevelopment or reconstruction of a parallel set of railroad tracks, said ballast underlying said parallel set of railroad tracks and extending under said railroad tracks from a first side to a second side, said process comprising:

(a) cementing said ballast by applying a multi-component adhesive to said ballast, said multi-component adhesive comprising a polyurethane resin adhesive;

(b) subsequently conducting said redevelopment or reconstruction of said parallel set of railroad tracks; and (c) subsequently mechanically breaking up said ballast without affecting reuse of said ballast.

3. A process for temporarily consolidating railroad track ballast while a parallel set of tracks is redeveloped or reconstructed, said ballast extending from a first side area to a second side area and said ballast underlying said parallel set of tracks, said process comprising:

supplying adhesive components under a pressure of from 30 to 200 bar to a mixing chamber;

turbulently mixing said adhesive components in said mixing chamber, thereby preparing a multi-component adhesive mixture, said multi-component adhesive mixture comprising an epoxide resin, and no solvents being employed in said multi-component adhesive mixture;

applying a flat curtain of said multi-component adhesive mixture under a pressure of from 2 to 6 bar in a laminar flow onto at least one of said first and second side areas of said ballast, thereby temporarily cementing said ballast in said side area; and subsequently breaking up said multi-component adhesive mechanically without affecting reuse of said ballast.

4. A process for temporarily consolidating railroad track ballast while a parallel set of tracks is redeveloped or reconstructed, said ballast extending from a first side area to a second side area and said ballast underlying said parallel set of tracks, said process comprising:

supplying adhesive components under a pressure of from 30 to 200 bar to a mixing chamber;

turbulently mixing said adhesive components in said mixing chamber, thereby preparing a multi-component adhesive mixture, said multi-component adhesive mixture comprising a polyurethane resin adhesive, and no solvents being employed in said multi-component adhesive mixture;

applying a flat curtain of said multi-component adhesive mixture under a pressure of from 2 to 6 bar in a laminar flow onto at least one of said first and second side areas of said ballast, thereby temporarily cementing said ballast in said side area; and subsequently breaking up said multi-component adhesive mechanically without affecting reuse of said ballast.

* * * * *